United States Patent [19]

Shaw

[11] 4,340,232

[45] Jul. 20, 1982

[54] ABACUS CHESS GAME

[76] Inventor: James K. Shaw, 4916 Erie St., Annandale, Va. 22003

[21] Appl. No.: 56,371

[22] Filed: Jul. 10, 1979

[51] Int. Cl.[3] ..... A63F 3/00

[52] U.S. Cl. ..... 273/260; 273/281

[58] Field of Search ..... 273/242, 243, 281, 260, 273/261

[56] References Cited

U.S. PATENT DOCUMENTS 4,123,062 10/1978 Wexler et al. ..... 273/243

4,171,814 10/1979 Tamano ..... 273/243

*Primary Examiner*—Richard C. Pinkham

*Assistant Examiner*—Carl Moy

*Attorney, Agent, or Firm*—Israel Gopstein

[57] ABSTRACT

A game is played by opposing players on an apparatus having a plurality of sets of movable playing pieces. The game board may have an abacus-like structure. The method of using the game board assigns hierarchical values to playing pieces on either side of a central divider, the playing pieces being movable from an open to an active position and vice versa. The board structure provides means for withdrawing a number of playing pieces from a set in an active position subsequent to a confrontation with an opposing set in accordance with the established hierarchy. At the conclusion of play the player having the largest number of remaining active playing pieces is determined to be the winner.

11 Claims, 4 Drawing Figures

ABACUS CHESS GAME

BACKGROUND OF THE INVENTION

1. Field of the Invention

The present invention relates to amusement games, and more particularly to games of confrontation involving a plurality of sets of playing pieces.

2. Prior Art

Devices utilizing abacus-like structures are known in the prior art, as illustrated by James, U.S. Pat. No. 815,174. In addition to James, amusement and educational devices are known to use sliding beads and labeled sliding elements. Such devices are found in Welbourn, U.S. Pat. No. Des. 227,585; Immer, U.S. Pat. Nos. 935,258; Ormsby, 2,274,342; Mills, 2,409,144 and Saunders, 3,144,252. Sliding elements are found in a scoreboard disclosed in Decepoli, 2,527,621.

None of the prior art, however, discloses or suggests a structure comprising movable pieces for playing a game of skill wherein sets of playing pieces are capable of confronting each other, the result of a confrontation potentially leading to a reduction in the number of active pieces available to one of the players.

SUMMARY OF THE INVENTION

The present invention accordingly provides a method for playing a game of skill utilizing a plurality of sets of playing pieces.

In the game according to the present invention a hierarchical order is given to the playing pieces in each of the sets, and the result of a confrontation between the two sets of playing pieces is made to depend upon the orders of the pieces involved.

A structure is provided for playing the game comprising an active play area and a storage area for playing pieces. The playing pieces are movable along guiding means extending from the playing area to the storage area.

The playing pieces may be marked by indicia for identifying the hierarchical orders thereof, and for providing an educational exposure to the players. Additional indicia are provided on the apparatus permitting an interaction between non-adjacent sets associated with a particular player thereby further exercising a player's skill.

These and other objects, features, and advantages of the present invention will become more readily apparent from the following specification and appended claims, when considered in conjunction with the attached drawings.

DETAILED DESCRIPTION OF THE PREFERRED EMBODIMENT

Figure 1:
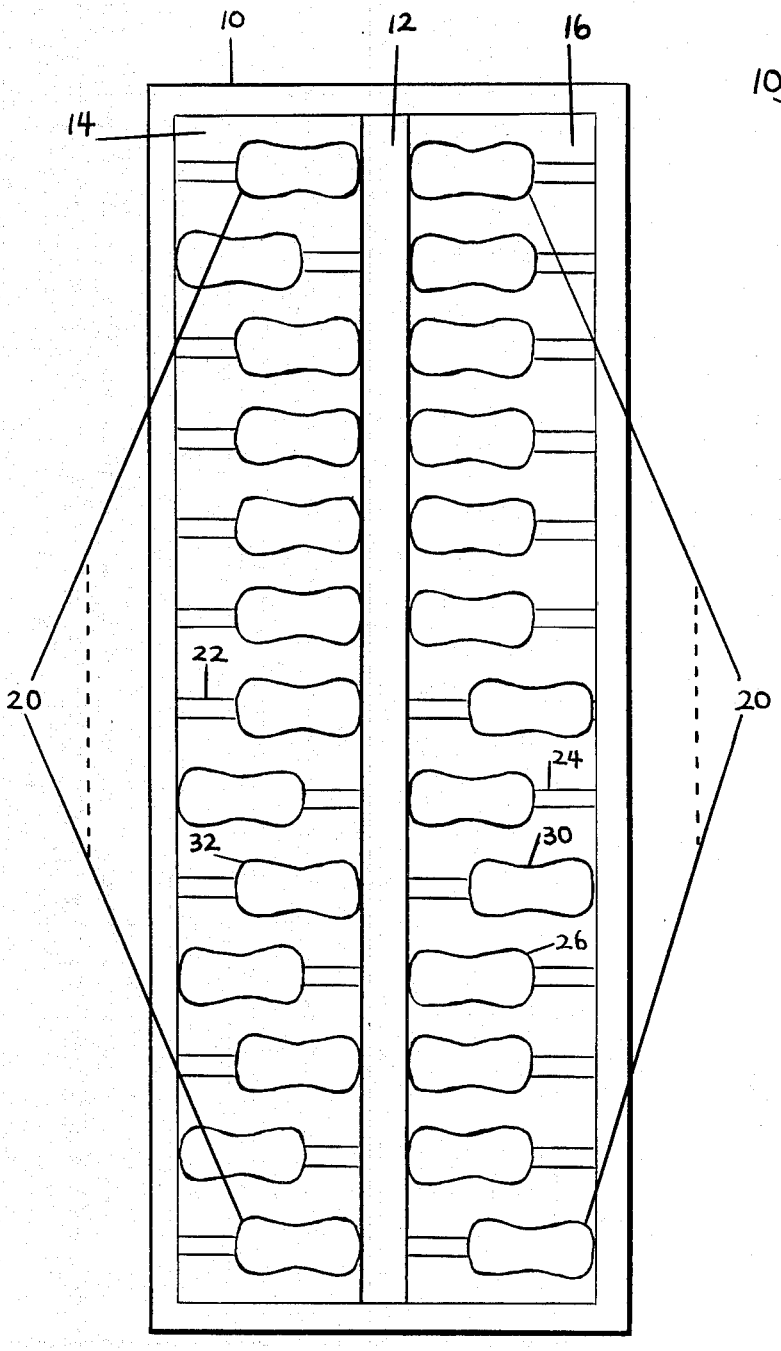
FIG. 1 shows a front view of a structure for a simplified game in accordance with the present invention.
Figure 2:
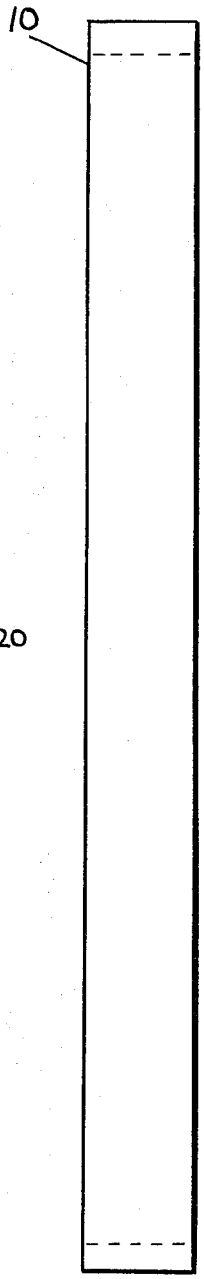
FIG. 2 shows a side view of the structure of FIG. 1.

The present invention involves development of a somewhat complicated game strategy. A simplified form of the present game is accordingly first presented and is shown in FIGS. 1 and 2. In FIG. 1 a frame 10 is shown to form a rectangular playing area. A central dividing member 12 divides the play area into two sections, generally shown at 14 and 16.

Plural playing pieces 20 are shown distributed in playing areas 14 and 16. A plurality of tracks, or guide means, is provided for playing pieces 20. Two such tracks are labeled as 22 and 24. The tracks may be formed by dowels inserted in frame 10 and in central dividing member 12. The dowels may extend completely through the central divider, or individual dowel portions may be inserted in each of the two play areas 14 and 16 formed by the central divider and frame 10. A side view of frame 10 is shown in FIG. 2, where it is seen that the dowels do not penetrate the frame. Conceivably, however, the dowels may be inserted in holes (not shown) formed in frame 10 as well as in central divider 12, thereby simplifying construction of the present game apparatus.

The game played with the structure of FIG. 1 utilizes each playing area for a separate player. That is, a first player controls playing pieces 20 found in play area 14, and a second player controls the playing pieces found in play area 16.

After determining which player proceeds first, the players move all their pieces 20 towards the central divider, and alternately open some of the pieces. That is, the players alternately remove one of their own pieces from the central divider to the frame. Pieces located adjacent the central divider are called active pieces, while those adjacent the frame structure are called open pieces. The initial step of arranging the pieces proceeds until each player has opened a predetermined number of pieces, such as five for example. In providing open positions, a player may not move a playing piece to an open position if the opponent's piece facing the particular playing piece is itself in the open position.

The purpose of providing the open positions is to enable movement of the pieces, which is comprised of a two-step procedure interchanging the positions of two pieces. First, an active piece, such as playing piece 26, is withdrawn to the open position, and secondly an immediately adjacent playing piece, such as 30, is moved from an open to an active position. Advancing a piece from the open to the active position constitutes the move made by a player. Such a move, when occurring opposite an active piece of the opponent, such as shown at 32, results in conquest of piece 32 by piece 30. Such conquest is indicated by withdrawing playing piece 32 from its active position to the open position and results in a net loss of strength of the player associated with play area 14. Players are preferably required to make a move, comprising an interchange as described between pieces 26 and 30, at each turn. That is, a pass is not permitted even if the result of the move will not be a conquest of an opponent's piece. Similarly, where a player has an opportunity of conquering an opponent's piece, he is required to do so rather than to elect to make a non-conquering interchange. Positioning considerations might lead a player to prefer not to conquer a particular piece, or to forego a turn, but the above-described rules are intended to force play to continue.

At some point during play, it may happen that all the pieces of one player are in an open position. At that point, the other player wins the game and may be awarded a point for winning, or a number of points in accordance with the number of remaining pieces in that other player's active position. Similarly, the game may be played under time constraints wherein the difference between the numbers of active pieces of the two players may be used to provide a number of points to one player after a predetermined period of elapsed time.

In view of the foregoing description of the game to be played on the structure of FIG. 1, it is seen that the tracks shown at 22 and 24 need not be comprised of dowels. In fact, the playing pieces may be mounted on wires connected to the frame. Similarly, channels or indentations in a playing surface may be provided, and may be used to guide the playing pieces in their motion from an active to an open position and vice versa. Channels in the playing pieces for tracks or wires may be fully enclosed within the pieces, or may be open to permit easy removal and replacement of a piece. It is clearly not required that the guide means restrain the playing pieces to remain in the plane of the playing area.

Figure 3:
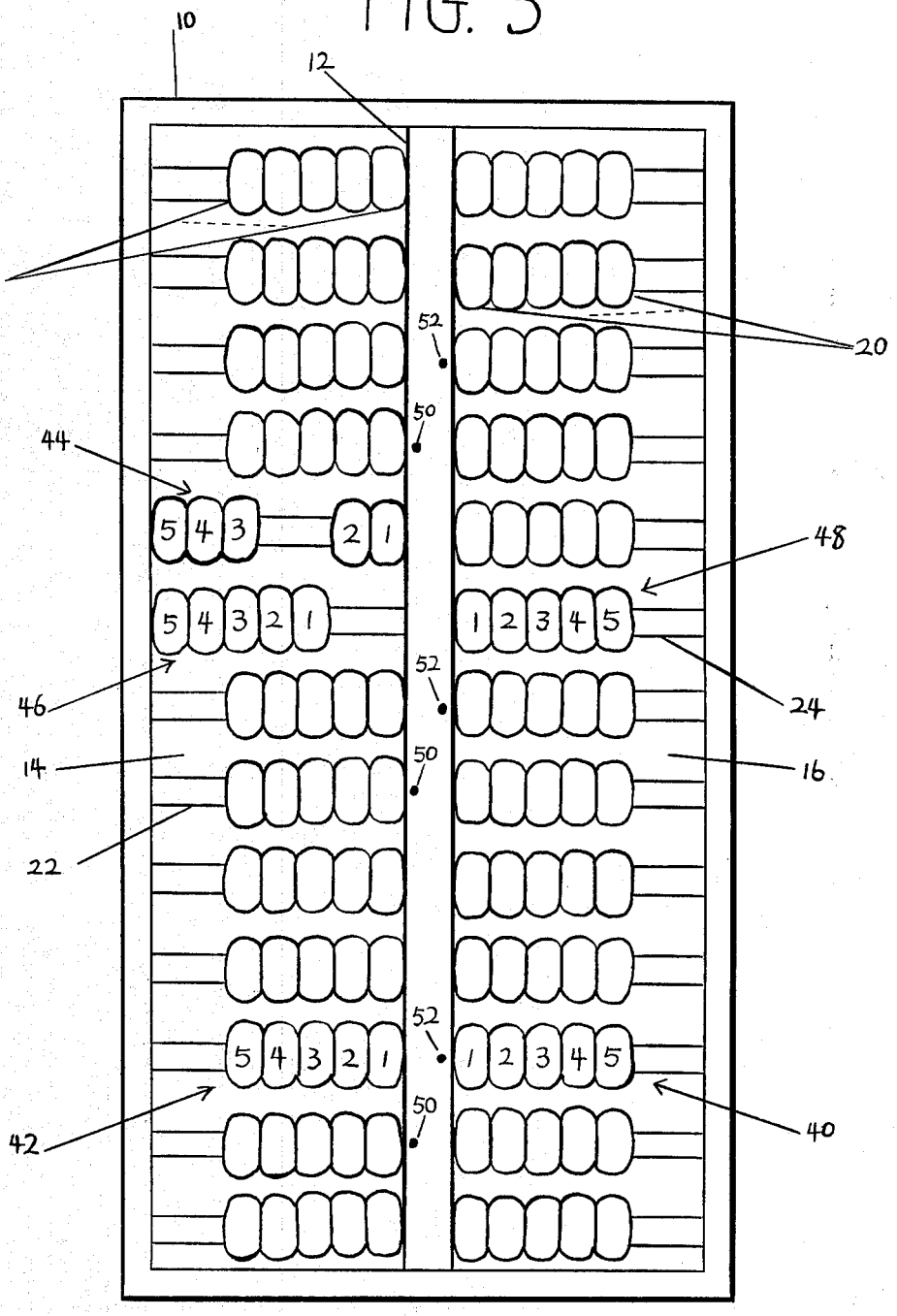
FIG. 3 shows a front view of a preferred embodiment of the structure of the present invention.

In a more complicated version of the invention, a game apparatus is shown in FIG. 3 comprising a frame 10, and a central dividing member 12 dividing the frame into two opposing playing areas 14 and 16. A plurality of tracks or guide means is shown illustratively by track 22 in playing area 14 and track 24 in playing area 16. A continuous track may extend from one side of frame 10 through the central dividing member 12 and to the other side of the frame. In that event, the track is seen to be divided into opposing portions by the central divider. The game may also be constructed with an open area dividing the tracks to form the opposing positions, and without requiring the use of central member 12.

Unlike the structure of FIG. 1, the inventive game of FIG. 3 is seen to comprise a plurality of playing pieces 40 at each portion of a track. The track is seen to perform the dual function of maintaining the playing pieces 40 in a predetermined sequence and, when any number of playing pieces 40 is withdrawn to the frame in the open position, of storing the withdrawn pieces. It is also seen that in keeping the playing pieces in a sequential order, the track establishes a hierarchy of the pieces. That is, playing pieces 40 in playing area 16 are shown to be illustratively labeled 1, 2, 3, 4, and 5, and the sequence of the numbered playing pieces will remain constant as long as the pieces remain on the track. A similar hierarchy is shown for playing pieces 42 in playing area 14. It is noted that in both playing areas the numerical designation of the pieces increase from the central, or active portion of the playing area to the storage portion of the playing area adjacent the frame.

Figure 4:
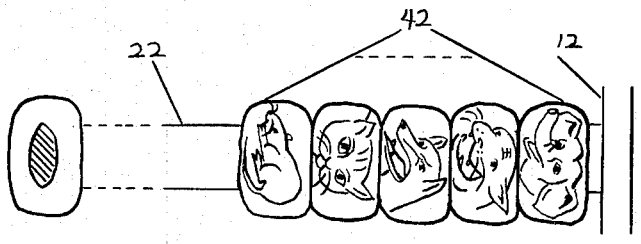
FIG. 4 shows a detail of the playing pieces of FIG. 3.

While FIG. 3 illustrates a numerical approach to designating the hierarchy of the playing pieces, it is quite clear that the pieces may be labeled with any indicia, such as the use of animal labels as shown in FIG. 4, or the use of military ranks such as General, Colonel, Captain, Sergeant and Private. As shown in FIG. 4, the playing pieces may be labeled with easily recognizable animals, such as an elephant, tiger, dog, cat and mouse. As may be more easily perceived by some players, the larger animals are stronger than, and can accordingly conquer, the smaller animals. That is, the hierarchy established in FIG. 3 by the use of numerals is just as easily established by utilization of military rank, animal heirarchy or the like. As also shown at FIG. 4, the playing pieces may have eliptical cross-sections for the tracks, thus preventing rotation of the pieces about the track and always presenting the identifying label to the player.

In playing the game according to the present invention, an entire set of playing pieces may be in the active area, as shown in FIG. 3 at 40 and 42. Alternatively, a set such as shown at 44 may include one subset of (2) playing pieces in the active area and a second subset of (3) playing pieces in the open area. In the present game, the established hierarchy favors a smaller number of pieces at the playing area. The playing pieces are interchanged as in the game of FIG. 1. Some explanation is required, however, in view of the use of a set of pieces at each track portion rather than a single piece for each track portion.

As shown at 46, a set may be completely open. An interchange between sets 44 and 46 may be effected by sliding the two active pieces of 44 to an open position, and sliding the uppermost two pieces (corresponding to numbers 1 and 2) of set 46 to the active or play area. The result of such an interchange in the present apparatus is to conquer pieces 3, 4 and 5 of set 48, symbolized by moving the same to the open area, thus leaving playing pieces 1 and 2 of set 48 at the active area. The player at playing area 14 would thus have conquered three of his opponent's playing pieces in the single move. Such conquests may be described in terms of the hierarchical preference previously described, wherein a lower number conquers a higher number and causes removal of the higher number. The game of the present invention may thus be described in terms of mathematical preferences, but it is appreciated that examples from the animal kingdom or from other fields may be utilized. That is, the basic rules for the game may remain constant, but with different identifying indicia the present invention is made useful as a special purpose game for different segments of the population. In all cases, however, the rules are essentially as follows:

The game utilizes several sets (thirteen, for example) of opposing pieces per player. Opposing sets confront each other across a central barrier, and can only attack one another. Each set includes a plurality of pieces (five, for example) arranged in a particular hierarchy. The hierarchical positions may be numerically described as 1, 2, 3, 4, 5, from central to outermost piece, with a piece of order K being able to conquer opponents pieces of hierarchical orders greater than K. A piece having a particular hierarchical order may also conquer an opponent's piece of the same order, provided that the two pieces confront each other alone. That is, no higher order pieces are associated with either one. Each set may have an open position (no active pieces in the center, or active play area) and an active position (at least one piece in the active area). When a player has an active set having some number of active pieces adjacent an open set, the sets' positions may effectively be interchanged by withdrawing the number of active pieces in the active set and forwarding an equal number of pieces from the open set to the central active area.

Attacking an opponent's players requires precisely such an interchange between adjacent active and open sets. The open set, upon being moved forward to the central area, at that point attacks the opponent's opposing set. If the opposing set is open, no conquest of the opponent's pieces results. If the opponent's set is active, conquest depends upon its hierarchical order. Thus, after attack by pieces 1 through K the opponent having $P>K$ pieces withdraws pieces $K+1$ through P to the inactive, or open area. If the opponent's active set constituted only pieces 1 through K, i.e., $P=K$, the opponent withdraws piece K to the inactive area. If the opponent's active set includes pieces 1 through $K-1$, i.e. $P<K$, he is superior to the attacking force and does not lose any pieces to the open area. The effect of advancing pieces 1 through K is then nullified and equivalent to advancing a set against an open set.

At each turn a move must be made, and no passing of turns is permitted. When an attack on an active set is possible, it must be made in preference to a mere interchange wherein a set is advanced against an open set. However a player may withdraw an entire active set from a position opposite an active set of an opponent. Such voluntary withdrawal qualifies as a required move. The voluntary withdrawal, however, may only be applied to a set including the full complement of five pieces.

Two special rules in the game involve the ability of the lowest order piece (No. 5) to conquer the highest order piece (No. 1). Thus a full set may conquer the nearly empty set, although in hierarchical considerations the reverse should occur. Finally, in certain designated non-adjacent sets (designated by dots 50 of one color for sets of one player and by dots 52 of another color adjacent to the specified sets of another player) individual pieces may be allowed to jump. That is, an active designated set may interchange with an inactive designated set rather than with its next adjacent inactive set. If the next adjacent designated set is similarly active, however, it may not be used in the jump. Pieces 2 and 4 are designated jumping elements, so that only active sets consisting of 2 or 4 pieces may jump to a next designated set.

In playing the game a decision is reached on the first player, whether by toss of a coin or other means. All sets start in the active position and the first player opens a first set. Set openings then alternate between the players, each player being permitted to open one set at a time, but only for sets opposed by the opponents active sets. While at least five sets are preferably to be opened, the maximum number of open sets from this preliminary process may be agreed upon by the players.

Play now proceeds in accordance with the preceding rules.

As previously described, the individual pieces may be labeled to indicate the hierarchical preference, wherein the larger animals may conquer, kill or eat the smaller animals, with the exception of the elephant being conquered by the mouse in accordance with the first special rules. To demonstrate a kill, a player, upon moving a set to the active area, withdraws his opponent's corresponding pieces as permitted by the rules.

The preceding specification describes, by way of illustration and not of limitation, a preferred embodiment of the invention. Equivalent variations of the described embodiment will occur to those skilled in the art. Such variations, modifications, and equivalents are within the scope of the invention as recited with greater particularity in the following claims, when interpreted to obtain the benefits of all equivalents to which the invention is fairly entitled.

What is claimed is:

1. A method for playing a game of skill on an apparatus having a frame, a central area enclosed by said frame, a plurality of guide means in said frame, said guide means divided into opposing portions associated with opposing players by said central area, a plurality of sets of playing pieces guided by said portions of said guide means, the method comprising the steps of:

(a) initially arranging the plural sets of playing pieces so that each player has a first predetermined non-zero number of sets in an active position adjacent the central area and a second predetermined non-zero number of sets in an open position having playing pieces thereof withdrawn from said central area;

(b) each player, in turn, interchanging members of an open set and an active set by guiding the playing pieces associated therewith on portions of said guiding means associated with the player; and (c) removing at least one of an opposing player's playing pieces from an active position to an open position in accordance with indicia provided for said playing pieces.

2. A method as recited in claim 1 wherein said arranging step comprises the steps of:

(a) placing all playing pieces of all players in the active position;

(b) alternating withdrawals by the players of one set at a time from an active position opposite an opposing players active set to the open position.

3. A method as recited in claim 1 wherein said interchanging step comprises the steps of withdrawing a number of playing pieces from an active set on one of a player's guide means portion to an open position, and advancing a number of playing pieces from an open set on a predetermined guide means portion to an active position, the number of pieces advanced equaling the number of active pieces withdrawn from the active set, said one of a player's guide means and said predetermined guide means both identified by indicia on the apparatus.

4. A method as recited in claim 1 wherein said interchanging step comprises the steps of withdrawing at least one member of an active set of playing pieces on one of a player's guide means portion to an open position, and advancing at least one member of (a number of playing pieces from) an open set on a guide means portion adjacent to said one guide means portion from an open position to an active position, the number of pieces advanced equaling the number of active pieces withdrawn.

5. A method as recited in claim 4 wherein said removing step further comprises the step of withdrawing a number of the opposing player's playing pieces from an active set on the guide means portion opposing said adjacent guide means portion, and retaining a number of playing pieces in the active set of the opposing player.

6. A method as recited in claim 5 wherein said retaining step comprises the step of observing the number, K, of playing pieces advanced in said interchanging steps;

observing the number, P, of playing pieces in the opposing player's active set;

comparing P and K;

retaining K pieces if P is greater than K;

retaining K−1 pieces if P equals K; and retaining P pieces if P is less than K.

7. A method as recited in claim 6 wherein said retaining step further comprises the step of retaining 0 pieces if the opposing player's active set contains one piece and if the number of playing pieces advanced in said interchanging step comprises the entirety of the set of playing pieces on said portion of guide means.

8. A method as recited in claim 6 further comprising the step of compelling a player to perform said interchanging step between interchanging steps of an opposing player.

9. A method as recited in claim 8 further comprising the step of compelling a player to perform the advancing portion of said interchanging step on a portion of a guide means having an active set at its opposing portion.

10. A method as recited in claim 8 wherein said compelling step comprises the step of satisfying the compulsion by voluntarily withdrawing a complete active set opposite an opposing player's active set.

11. A method as recited in claim 1 further comprising the step of declaring a player having the largest number of remaining playing pieces to be the winner of the game.

* * * * *